United States Patent [19]

Krause

[11] Patent Number: 5,074,377

[45] Date of Patent: Dec. 24, 1991

[54] JOINTED LADDER

[75] Inventor: Guenther Krause, Alsfeld, Fed. Rep. of Germany

[73] Assignee: Krause-Werk GmbH & Co. KG, Alsfeld, Fed. Rep. of Germany

[21] Appl. No.: 435,015

[22] Filed: Nov. 9, 1989

[30] Foreign Application Priority Data

Nov. 12, 1988 [DE] Fed. Rep. of Germany ..... 8814195

[51] Int. Cl.[5] ..... E06C 1/30; E06C 1/38; E06C 7/08

[52] U.S. Cl. ..... 182/167; 182/209

[58] Field of Search ..... 182/166, 167, 228, 194, 182/104, 209, 204, 23

[56] References Cited

U.S. PATENT DOCUMENTS

| | | | |
|---|---|---|---|
| 745,320 | 12/1903 | Bruno | 182/167 |
| 858,839 | 7/1907 | Upton | 182/166 |
| 2,350,129 | 5/1944 | Richards | 182/23 |
| 3,692,143 | 9/1972 | Kummerlin | 182/167 |
| 4,182,431 | 1/1980 | Wing | 182/167 |
| 4,210,224 | 7/1980 | Kummerlin | 182/166 |
| 4,376,470 | 3/1983 | Ashton | 182/23 |
| 4,407,045 | 10/1983 | Boothe | 16/327 |
| 4,606,432 | 8/1986 | Belt | 182/204 |

FOREIGN PATENT DOCUMENTS

| | | | |
|---|---|---|---|
| 2228045 | 12/1973 | Fed. Rep. of Germany | 182/167 |
| 2409293 | 9/1975 | Fed. Rep. of Germany | 182/166 |
| 2750665 | 5/1979 | Fed. Rep. of Germany . | |
| 3446255 | 6/1986 | Fed. Rep. of Germany . | |
| 2081793 | 2/1982 | United Kingdom . | |

*Primary Examiner*—Reinaldo P. Machado
*Attorney, Agent, or Firm*—Flynn, Thiel, Boutell & Tanis

[57] ABSTRACT

The invention relates to a jointed ladder comprising two ladder elements connected by a joint. According to the invention a telescopic ladder element is supported movably on each ladder element and can be locked by means of a locking mechanism in order to be able to adjust the jointed ladder to different operating heights. The jointed ladder of the invention can be utilized for all purposes.

22 Claims, 5 Drawing Sheets

JOINTED LADDER

FIELD OF THE INVENTION

The invention relates to a jointed ladder comprising two ladder elements connected through joints and each including several crosspieces secured on parallel sidepieces.

BACKGROUND OF THE INVENTION

It is disadvantageous in known jointed ladders that they cannot be adjusted in their height. Thus, either the maximum possible operating height of a jointed ladder is limited, which in a collapsed state has small dimensions for transporting, or a common jointed ladder having a high operating height is very bulky and difficult to transport when in the collapsed state.

The basic purpose of the invention is to provide a jointed ladder of the above-mentioned type, which, having a simple design and being able to be manufactured inexpensively, has small dimensions for transport and can be adjusted to a large operating height.

SUMMARY OF THE INVENTION

The purpose is attained according to the invention by a further telescopic ladder element being supported longitudinally movably on each original ladder element, which telescopic ladder element can be fixed elevationally adjustably on the original ladder element by means of a locking mechanism.

The jointed ladder of the invention is distinguished by a number of significant advantages. Since the telescopic ladder element utilized for the extension is supported on the original ladder element, it is possible to design the ladder element in the usual manner, namely it is possible to equip a commercially available jointed ladder by means of the telescopic ladder element such that the ladder can be elevationally adjustable over a large elevational range. Furthermore, the telescopic ladder element does not influence the stability of the ladder element of the jointed ladder since attachments weakening the ladder element are not needed. In addition, the two ladder elements can be connected through a common joint.

A particularly favorable further development of the invention provides that the sidepieces of the telescopic ladder element rest each against the outer side of the sidepieces of the ladder element and at least partially grip around the sidepieces. It can thereby be particularly advantageous that the sidepieces of the telescopic ladder element have a substantially U-shaped cross section. This design of the sidepieces of the telescopic ladder element enables them to be supported fixedly and stable on the respective ladder element without any danger of damaging the profiles of the sidepieces and/or of the crosspieces of the ladder element, since a large contact surface exists between the sidepieces of the telescopic ladder element and the sidepieces of the ladder element.

In order to lower the manufacturing expenses and in order to simplify the design of the jointed ladder of the invention, it can be particularly advantageous to construct the crosspieces of the telescopic ladder element in the form of hollow profiles compressed at their ends. It is not necessary in this design to provide additional covers or others at the ends of the crosspieces. Furthermore, the danger of injuries is reduced since no edges or only insignificant edges exist. It is particularly advantageous according to a further development of the invention when the sidepieces of the telescopic ladder element each have one longitudinal groove, in which the ends of the crosspieces, namely the compressed end areas, are secured. On the one hand, it is possible in this manner for a particularly safe support of the crosspieces to occur, on the other hand, the end area of the crosspieces is embraced so that exposed sharp edges, which can result in injuries, are avoided. Furthermore, this design permits connection of the crosspieces to the respective sidepiece by means of only one single welding seam. This measure significantly reduces, on the one hand, the manufacturing expenses and, on the other hand, it is particularly advantageous for reasons of appearance if only one single welding seam is needed.

The locking mechanism according to the invention can include at least one locking knob movably supported on the respective sidepiece of the telescopic ladder element and introducible into recesses of the ladder element. It can thereby be furthermore advantageous when the locking knob can be introduced into the front recesses of the crosspieces of the original ladder element. Since the crosspieces are usually constructed in the form of hollow profiles being placed through recesses of the respective sidepieces and being flanged, recesses already exist which can be used for the locking mechanism. Additional recesses, notches or others on the sidepieces of the ladder element are thus not needed. The ladder element is thus not weakened by mounting the locking mechanism. Also the danger of damaging the profiles of the ladder element does not exist. Since furthermore the locking knob is supported on the respective sidepiece of the telescopic ladder element, an optimum association of the locking mechanism with the sidepiece of the telescopic ladder element is always guaranteed so that a sufficient stability exists.

The locking knob has preferably a bolt, which can be looked in at least two different longitudinally movable positions by means of a locking element. Thus it is possible to engage the locking knob in a locking state and also in a released state. Thus it is avoided on the one hand that the locking mechanism releases by itself during the use of the jointed ladder and it is assured on the other hand that the telescopic ladder element can be moved relative to the ladder elements of the jointed ladder without that the locking knob prevents unintentionally the movement.

A further, particularly favorable design of the jointed ladder of the invention provides that one connecting element each is supported on an upper end of a sidepiece of a telescopic ladder element, with the connecting element being securable on the upper end of the respective sidepiece of the other telescopic ladder element. This design makes it possible according to the invention that the two telescopic ladder elements can be separated from the original ladder element and can be connected separately with one another.

The operator thus has the possibility to form two double ladders, one out of the ladder elements connected by the joint and the other from the two connected telescopic ladder elements, over which double ladders a board or the like can be placed in order to form a scaffold. The possibility to separate the telescopic ladder elements from the ladder elements of the jointed ladder creates furthermore the possibility to reduce the total weight of the jointed ladder in case said ladder is supposed to be transported with only a low needed operating height.

A connecting element in the form of a fishplate pivotally supported on the respective sidepiece is used for the safe connection of the two telescopic ladder elements. The free end of said fishplate has a recess for guiding the locking knob of the respective other telescopic ladder element therethrough.

Thus, it is possible according to the invention to use the locking knobs of the telescopic ladder elements for connecting the two telescopic ladder elements by means of the connecting element. This design has the advantage that damages of the profile of the telescopic ladder elements are avoided, since the fastening points of the locking knobs, through which the force introduction occurs, already have a sufficient solidity. It can furthermore be advantageous to provide the upper end of the sidepiece of the telescopic ladder element with a slotlike recess for guiding the fishplate therethrough. Since the place of fastening the fishplate is fixed, the slotlike recess can be constructed such that same extends only over a small area of the entire length of the sidepiece. This does not influence the total stability of the telescopic ladder element, however, creates the possibility for specific bearing surfaces for the fishplate in order to guarantee a sufficiently stable fastening of the upper areas of the sidepieces. It is to be pointed out in particular thereby that the upper areas of the sidepieces are not directly supported against one another but each against the locking knob or rather the fishplate so that damages of the profile of the sidepieces are avoided.

The fishplate is preferably supported pivotally below the respectively associated locking knob. Since the fishplate is pivoted upwardly under stress at a connection of the upper area of the sidepieces of the telescopic ladder element, said fishplate rests on the locking knob or rather its bolt and is supported by same. This also avoids damages of the profile of the sidepieces of the telescopic ladder element.

In order to be able to safely set up the jointed ladder of the invention also on uneven ground, for example on stairs or others, it can be particularly advantageous that one extension stay is supported on the lower end of each sidepiece of the telescopic ladder element. It is thus possible to vary each of the sidepieces separately in its length. The extension stay is movable preferably along the sidepiece and can be looked by means of a locking mechanism. It can thereby be advantageous to construct the extension stay with a cross section corresponding approximately with the cross section of the ladder elements so that a stable hold on the sidepiece of the telescopic ladder element is assured.

To increase the stability of the jointed ladder of the invention it can furthermore be advantageous to laterally spread apart the lower ends of the sidepieces of the telescopic ladder element.

The jointed ladder of the invention is, as described, built of simple, inexpensively manufacturable individual parts and can be manufactured easily. From all of this result very low total costs and an economical manufacturing possibility.

By suitably designing the joint connecting the two ladder elements, it is possible to move the two ladder elements from the resting position into an aligning position pivoted at 180° so that the ladder of the intention can be used as a leaning ladder which does not stand free. Thus, a very high operating height can be achieved with the telescopic ladder elements. Furthermore, intermediate positions are possible.

BRIEF DESCRIPTION OF THE DRAWINGS

The invention will be described hereinafter in connection with one exemplary embodiment and the drawings, in which.

DETAILED DESCRIPTION

The jointed ladder according to the invention includes two ladder elements 1 connected to one another by means of a joint 6 arranged at its upper end. The joint 6 has a usual (conventional) design and can be locked at specific angles of traverse.

Figure 4:
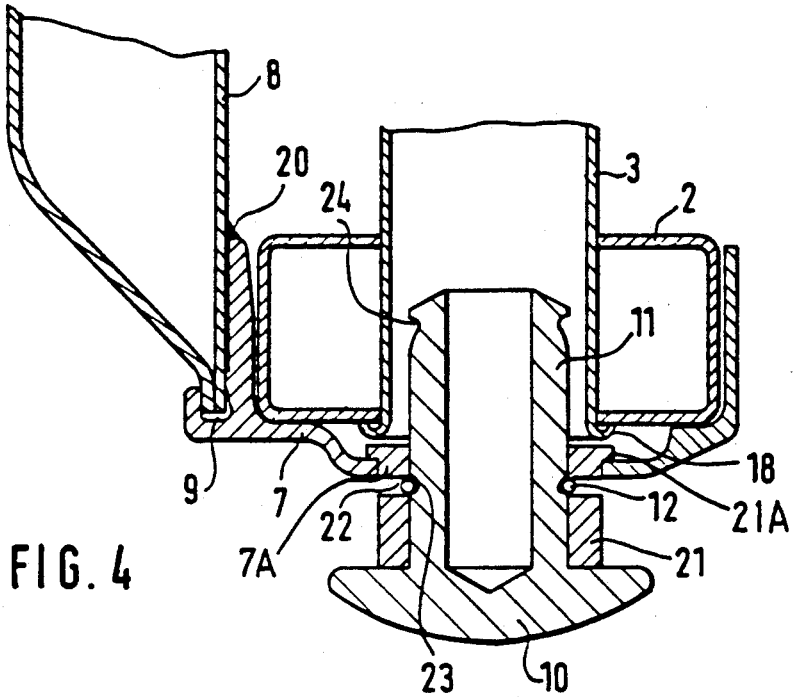
FIG. 4 is a cross-sectional view taken along the line IV—IV of FIG. 1.
Figure 5:
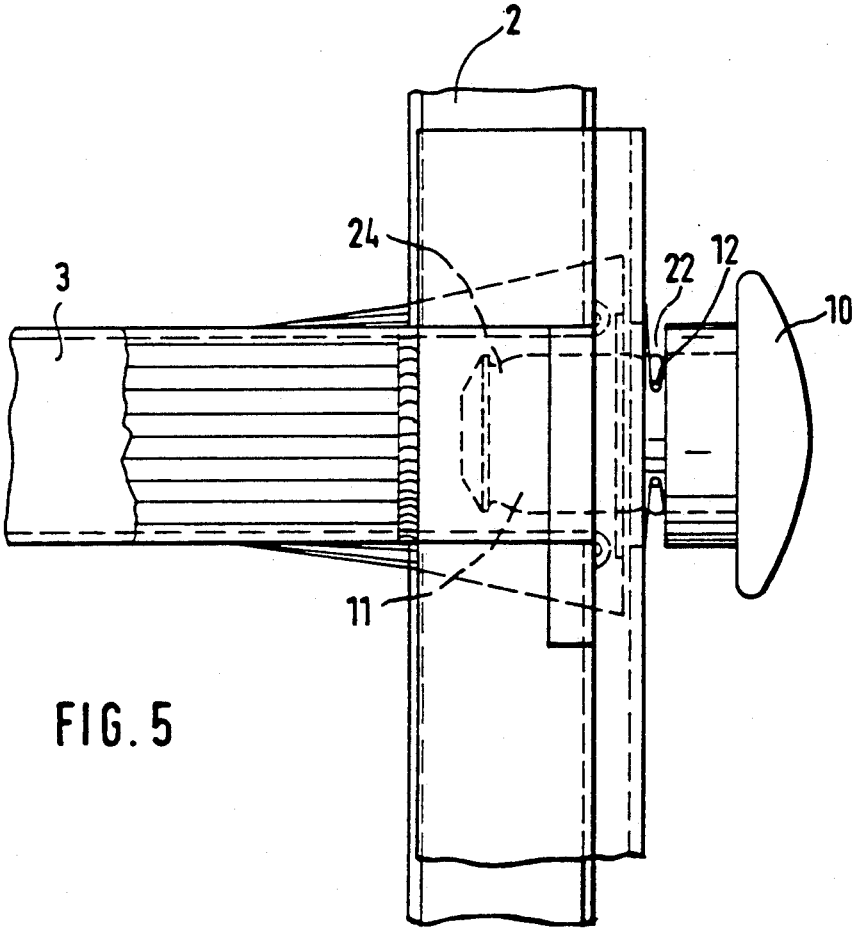
FIG. 5 is a detail side view according to the direction of view V taken of FIG. 1.

The ladder elements 1 include two sidepieces 2, into which several crosspieces 3 are inserted. FIG. 4 shows the sidepieces 2 having a rectangular cross section and square or quadratic recesses. The crosspieces 3, which are also constructed with a hollow profile, can be fittingly inserted into the recesses. The outer ends of the crosspieces 3 are each fastened to the sidepieces 2 by means of a flanging 18. The inside of the hollow profiles of the crosspieces 3 is thereby accessible from the outside of the sidepieces 2.

Telescopic ladder elements 4 are each supported on the sidepieces 2 of the ladder elements 1. The telescopic ladder elements 4 each include two sidepieces 7 and several crosspieces 8. The design of the telescopic ladder elements will be described in greater detail later on. The telescopic ladder elements can be moved along the ladder elements 1 and can be fixed in their respective position by means of locking mechanisms 5. The sidepieces 7 each have one base 19 at their lower ends.

Figure 1:
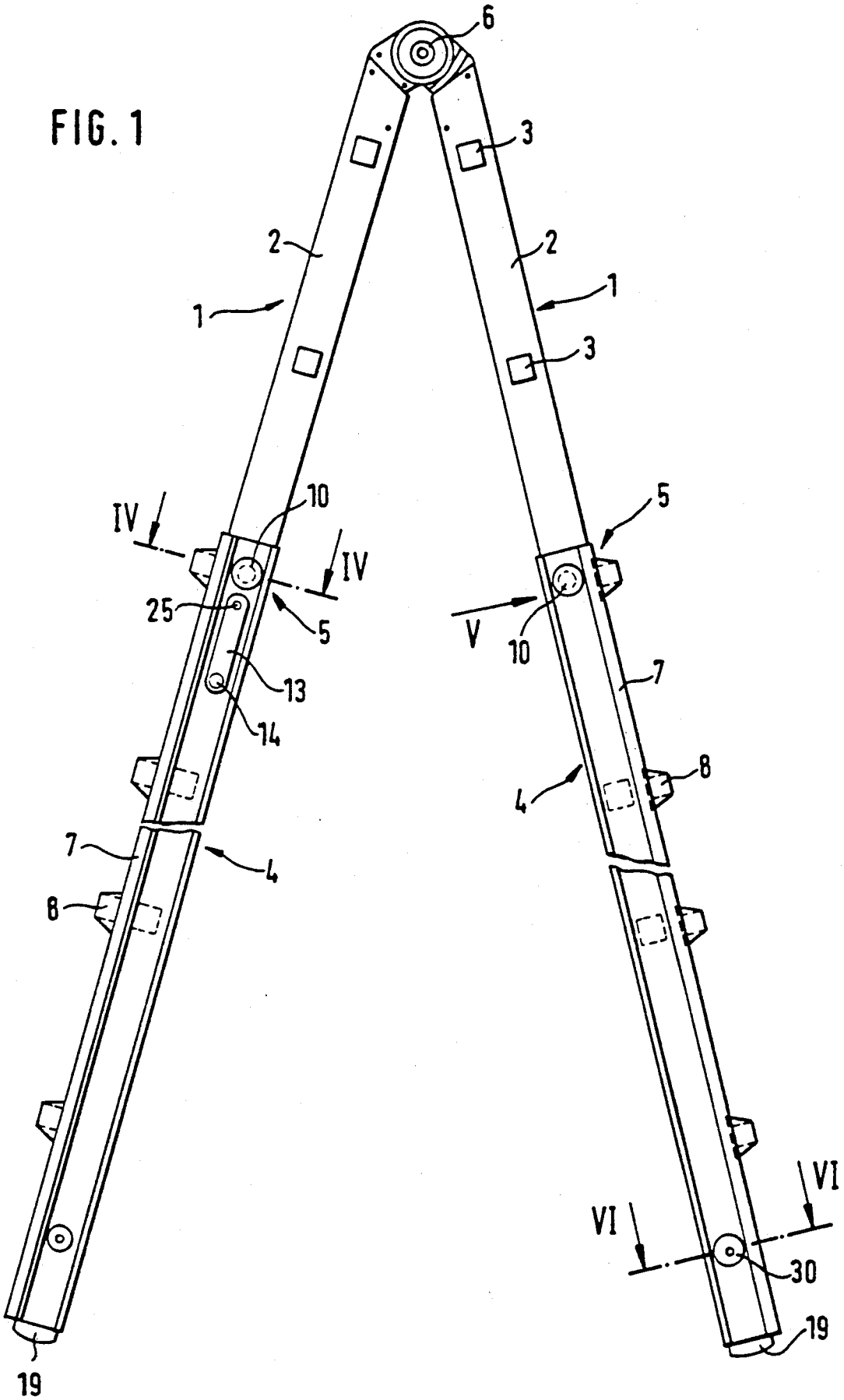
FIG. 1 is a side view of the jointed ladder of the invention in an operating condition.

FIG. 4 is a cross-sectional view taken along the line IV—IV of FIG. 1. It shows that the sidepiece 7 of the telescopic ladder element is substantially U-shaped in cross section and grips around the sidepiece 2 of the ladder element 1 on three sides. A longitudinal groove 9 is constructed on one outer side of the U-shaped cross section.

The crosspieces 8 of the telescopic ladder element 4 are also constructed with a preferably square hollow profile and are compressed such at their ends that the ends can be guided into the longitudinal groove 9. The crosspieces 8 are fastened to the sidepiece 7 by means of a welding seam 20.

An opening 7A exists on the side surface of the sidepiece 7, into which opening is guided a guide sleeve 21, in which is supported a locking knob 10 or rather its bolt 11. The guide sleeve 21 has an enlarged head part 21A at one end thereof as well as a groove 22 therein axially spaced from the enlarged head 21A about the thickness of the wall of the sidepieces 7 as is particularly shown in FIG. 4, in which is arranged a locking element 12, preferably in the form of a wire-shaped spring element. Two annular grooves 23, 24 are provided on the outer periphery of the bolt 11, with the annular groove 24 being thereby provided adjacent an end area of the bolt 11 remote from the looking knob 10, while the annular groove 23 is constructed at the area adjacent the locking knob 10. The annular grooves 23, 24 are designed such that the spring-like locking element 12 can be moved into the annular groove 23 or 24 to engage the locking knob 10. It is thus possible to lock the locking knob 10 in the position shown in FIG. 4, in which it projects into the recess of the crosspiece 3 and assures a safe fixation of the telescopic ladder element 4 relative to the ladder element 1. When the locking knob 10 is pulled outwardly so that the locking element 12 is received in the annular groove 24, it is possible to move the telescopic ladder element 4 relative to the ladder element 1.

Figure 2:
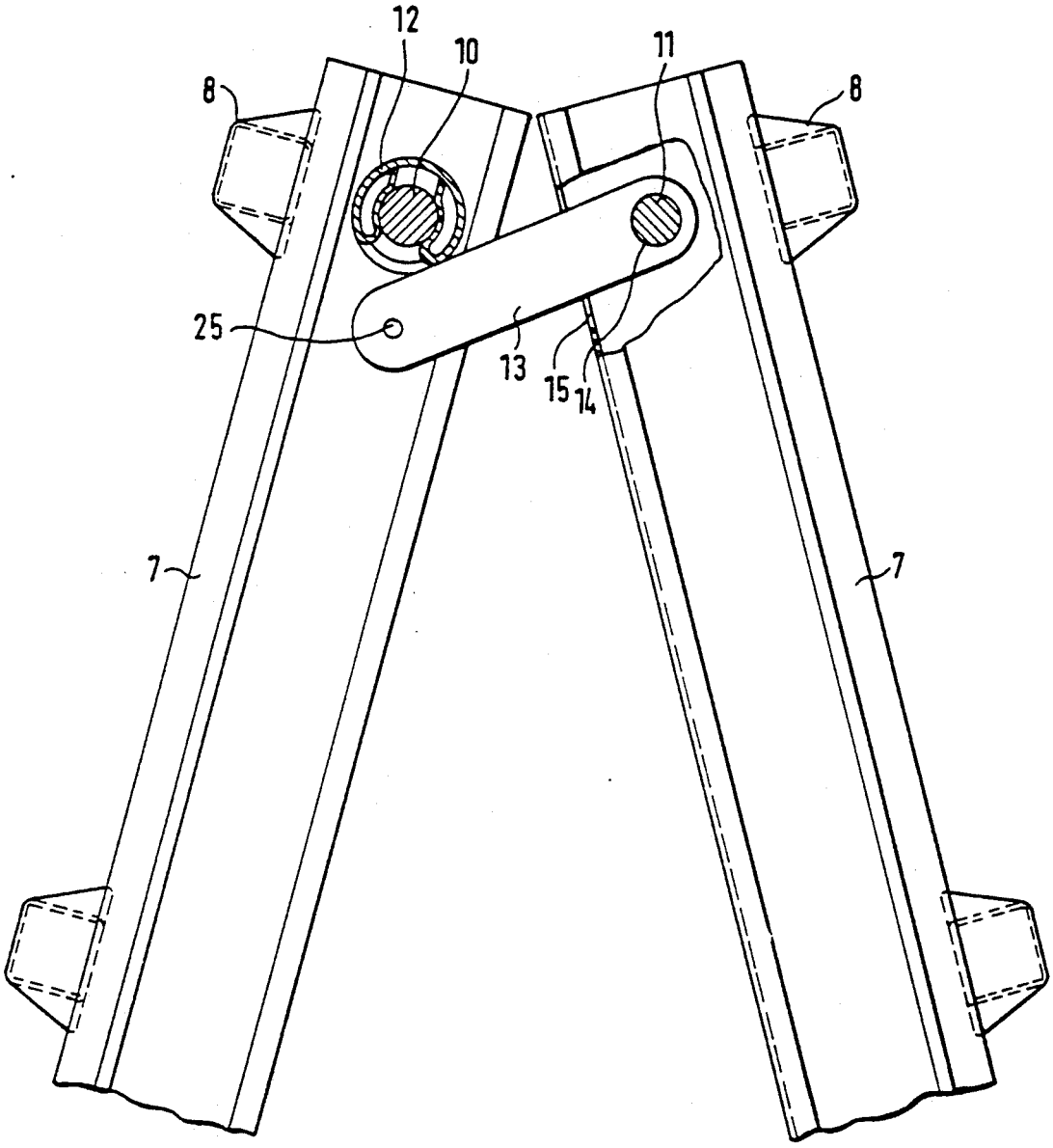
FIG. 2 is a side view of the upper ends of the connected sidepieces of the telescopic ladder elements.

Fishplates 13 are supported at the upper area of the one (left in FIG. 2) telescopic ladder element 4 in the illustrated exemplary embodiment. Said fishplates 13 can each be pivoted about a fulcrum point 25. One fishplate 13 is provided on each lateral side of the telescopic ladder element 4. The free end of each fishplate has an opening 14 dimensioned such that the bolt 11 of the locking knob 10 of the respective other telescopic ladder element 4 can be guided through the opening 14. The fulcrum point 25 lies below the associated locking knob 10, as this is illustrated in FIG. 2. The fishplate 13 enables the connection of the upper areas of the telescopic ladder elements 4 when same are removed, as shown in FIG. 2, in order to be able to construct in this manner a separate free-standing double ladder.

FIG. 2 shows that the sidepiece 7 has a slotlike opening 15 at its upper end, through which opening 15 the fishplate can be placed. The fishplate 13 rests in the operative condition shown in FIG. 2 against the locking knob 10 arranged above its fulcrum point 25 and against the wall of the opening 15 so that damage of the profile of the sidepieces 7 is avoided.

Figure 3:
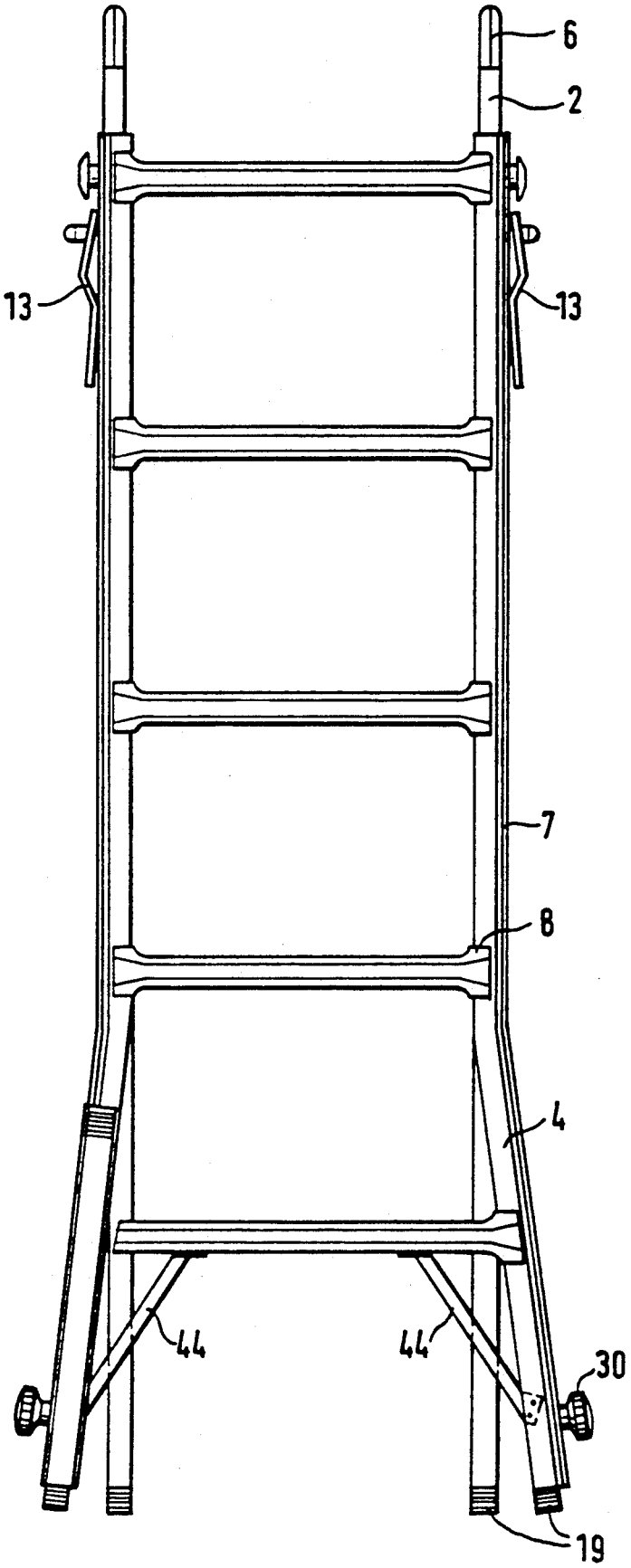
FIG. 3 is a front view of the jointed ladder illustrated in FIG. 1.

The lower ends of the telescopic ladder elements 4 can, as shown in FIG. 3, each be spread laterally to increase in this manner the base width and thus the stability of the jointed ladder. To improve the stability it is possible to reinforce the lower ends with stays 44 engaging the crosspieces 8.

Figure 6:
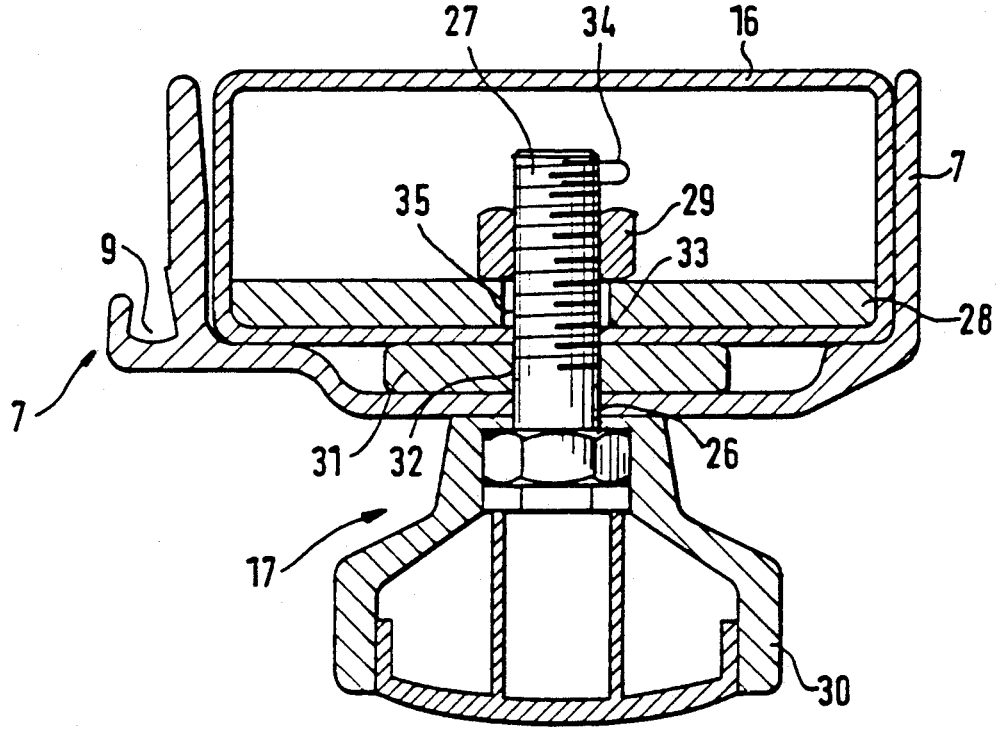
FIG. 6 is a cross-sectional view along the line VI—VI of FIG. 1.

FIG. 6 is a cross-sectional view taken along the line VI—VI of FIG. 1. In order to enable setting up of the jointed ladder of the invention also on uneven ground or on stepped ground, for example on steps, extension stays 16 are each supported on the lower end of the sidepieces 7 of the telescopic ladder element 4, which stays 16 are moveable along the respective sidepiece 7 and are fixable by means of a locking mechanism 17. The extension stay 16 has substantially the same cross section as the sidepiece 2 of the ladder element 1 so that the extension stay can be fixedly enclosed by the profile of the sidepiece 7 of the telescopic ladder element 4. A bore 26 is constructed at the lower area of the telescopic ladder element. A threaded bolt 27 extends through the bore 26 and also through a bore 32 in a plate 31, through a slotted hole 33 in the extension stay 16 and through a bore 35 of a pressure plate 28. A nut 29 is screwed onto the threaded bolt 27, which nut is connected fixed against rotation to the pressure plate 28 and can be braced against the inner side of the extension stay. The threaded bolt 27 is connected to a manual control button or knob 30. Thus, by loosening the thread bolt 27, it is possible to move the extension stay 16 relative to the pressure plate 28 and thus to the sidepiece 7 and to fix it in the desired position. The threaded bolt 27 is secured against an unintended turning out by a splint 34.

Thus, the inventive jointed ladder enables the movement of the telescopic ladder elements 4 relative to the ladder elements 1 by operating the locking knob 10 in order to vary in this manner the operating height of the ladder. Since the locking by means of the locking knobs 10 takes place on the crosspieces 3 of the ladder elements, it is assured that, as shown in FIG. 1, an association of the crosspieces 8 of the telescopic ladder elements with the crosspieces 3 of the ladder elements 1 occurs at all times so that the operator cannot be bothered by an unfavorable spacing relationship of the individual crosspieces 3 and 8. It is possible according to the invention to move the telescopic ladder elements 4 each completely onto the ladder elements 1 or to separate same completely from the ladder elements 1 in order to connect, as shown in FIG. 2, the telescopic ladder elements 4 with one another and to have available in this manner a separate free-standing double ladder. By pivoting the joint 6, it is furthermore possible to align the ladder elements 1 with one another so that a very high, not standing free, ladder (i.e., a linear extension ladder) can be formed.

The invention is not to be limited to the illustrated exemplary embodiment, rather many design possibilities exist for the man skilled in the art within the scope of the invention.

The embodiments of the invention in which an exclusive property or privilege is claimed are defined as follows:

1. In a jointed ladder comprising at least two ladder elements connected through joints and each having several crosspieces secured on parallel first sidepieces, the improvement wherein a telescopic ladder element is supported longitudinally movably on each ladder element, wherein the telescopic ladder element includes second sidepeices which rest against an outer side of each of said first sidepieces of said ladder element, and wherein the second sidepieces of said telescopic ladder element have a substantially U-shaped cross section so that the second sidepieces also at least partially grip around said first sidepieces, said U-shaped second sidepieces having a bright portion on which is provided an opening and in which opening is provided an elongated and hollow guide sleeve means, and wherein each telescopic ladder element includes a locking means for elevationally and adjustably fixing the position of the telescopic ladder element on the associated ladder element, said locking means including at least one locking knob means movably supported inside said hollow guide sleeve means and further including means on said locking knob means introducible into said hollow guide sleeve means and a selected opening provided in a respective first sidepiece of a respective ladder element when said selected opening is axially aligned with the hollow interior of said guide sleeve means, wherein further crosspieces are provided on said telescopic ladder element and extend between and are connected to said second sidepieces, wherein said crosspieces are elongated hollow profiles having opposite ends, said opposite ends being closed by pressing the material thereat to form an edge end, and wherein said second sidepieces of the telescopic ladder element each have a longitudinal groove thereon, into which a said end edge of a said crosspiece is secured.

2. The jointed ladder according to claim 1, wherein an extension stay is supported on a lower end of said second sidepiece of said telescopic ladder element.

3. The jointed ladder according to claim 2, wherein said extension stay is movable along said second sidepiece and is fixedly positioned by said locking means.

4. The jointed ladder according to claim 1, wherein lower ends of said second sidepieces of said telescopic ladder element are spread apart laterally.

5. The jointed ladder according to claim 1, wherein said joints which connect said two ladder elements, when the ladder is used as a leaning, not free-standing ladder, are pivotal over a range of approximately 180° and can be maintained fixedly positioned in this position as well as in intermediate positions.

6. In a jointed ladder comprising at least two ladder elements connected through joints and each having several crosspieces secured on parallel first sidepieces, the improvement wherein a telescopic ladder element is supported longitudinally movably on each ladder element, wherein the telescopic ladder element includes second sidepieces which rest against an outer side of each of said first sidepieces of said ladder element, and wherein the second sidepieces of said telescopic ladder element have a substantially U-shaped cross section so that the second sidepieces also at least partially grip around said first sidepieces, said U-shaped second sidepieces having a bight portion on which is provided an opening and in which opening is provided an elongated and hollow guide sleeve means, and wherein each telescopic ladder element includes a locking means for elevationally and adjustably fixing the position of the telescopic ladder element on the associated ladder element, said locking means including at least one locking knob means movably supported inside said hollow guide sleeve means and further including means on said locking knob means introducible into said hollow guide sleeve means and a selected opening provided in a respective first sidepiece of a respective ladder element when said selected opening is axially aligned with the hollow interior of said guide sleeve means, wherein plural one of said crosspieces are hollow, and wherein said selected opening is defined by the hollow interior of said crosspiece.

7. In a jointed ladder comprising at least two ladder elements connected through joints and each having several crosspieces secured on parallel first sidepieces, the improvement wherein a telescopic ladder element is supported longitudinally movably on each ladder element, wherein the telescopic ladder element includes second sidepieces which rest against an outer side of each of said first sidepieces of said ladder element, and wherein the second sidepieces of said telescopic ladder element have a substantially U-shaped cross section so that the second sidepieces also at least partially grip around said first sidepieces, said U-shaped second sidepieces having a bight portion on which is provided an opening and in which opening is provided an elongated and hollow guide sleeve means, and wherein each telescopic ladder element includes a locking means for elevationally and adjustably fixing the position of the telescopic ladder element on the associated ladder element, said locking means including at least one locking knob means movably supported inside said hollow guide sleeve means and further including means on said locking knob means introducible into said hollow guide sleeve means and a selected opening provided in a respective first sidepiece of a respective ladder element when said selected opening is axially aligned with the hollow interior of said guide sleeve means, wherein said locking knob means includes a longitudinally movable elongated portion, and wherein said locking means includes means for locking said elongated portion in at least two different, longitudinally movable positions.

8. In a jointed ladder comprising at least two ladder elements connected through joints and each having several crosspieces secured on parallel first sidepieces, the improvement wherein a telescopic ladder element is supported longitudinally movably on each ladder element, wherein the telescopic ladder element includes second sidepieces which rest against an outer side of each of said first sidepieces of said ladder element, and wherein the second sidepieces of said telescopic ladder element have a substantially U-shaped cross section so that the second sidepieces also at least partially grip around said first sidepieces, said U-shaped second sidepieces having a bight portion on which is provided an opening and in which opening is provided an elongated and hollow guide sleeve means, and wherein each telescopic ladder element includes a locking means for elevationally and adjustably fixing the position of the telescopic ladder element on the associated ladder element, said locking means including at least one locking knob means movably supported inside said hollow guide sleeve means and further including means on said locking knob means introducible into said hollow guide sleeve means and a selected opening provided in a respective first sidepiece of a respective ladder element when said selected opening is axially aligned with the hollow interior of said guide sleeve means, wherein a connecting element is supported on an upper end of each of said second sidepieces of at least one telescopic ladder element, which connecting element can be fastened to an upper end of a respective second sidepiece of an other telescopic ladder element, and wherein said connecting element includes an elongated fishplate and pivot means for pivotally supporting one end of said fishplate on a respective second sidepiece, a free end of said fishplate having an opening therein to guide said elongated portion of said locking knob means on said other telescopic ladder element therethrough.

9. The jointed ladder according to claim 8, wherein said upper end of said second sidepiece of said other telescopic ladder element is provided with means defining a slotlike recess to guide said fishplate therethrough.

10. The jointed ladder according to claim 8, wherein said fishplate is supported on said at least one telescopic ladder element below its respective locking knob means.

11. In a jointed ladder comprising at least two ladder elements connected through joints and each having several crosspieces secured on parallel first sidepieces, the improvement wherein a telescopic ladder element is supported longitudinally movably on each ladder element, wherein the telescopic ladder element includes second sidepieces which rest against an outer side of each of said first sidepieces of said ladder element, and wherein the second sidepieces of said telescopic ladder element have a substantially U-shaped cross section so that the second sidepieces also at least partially grip around said first sidepieces, said U-shaped second sidepieces having a bight portion on which is provided an opening and in which opening is provided an elongated and hollow guide sleeve means, and wherein each telescopic ladder element includes a locking means for elevationally and adjustably fixing the position of the telescopic ladder element on the associated ladder element, said locking means including at least one locking knob means movably supported inside said hollow guide sleeve means and further including means on said locking knob means introducible into said hollow guide sleeve means and a selected opening provided in a respective first sidepiece of a respective ladder element when said selected opening is axially aligned with the hollow interior of said guide sleeve means, and wherein said guide sleeve means is retained in said opening in said bight portion by means defining an enlarged head on one side of said bight portion, which enlarged head is larger than said opening in said bight portion, and wherein a further means is provided which defines a groove in an exterior of said guide sleeve means into which groove is received a spring means, said locking knob means including an elongated portion and a manually engageable knob at one end of said elongated portion, said elongated portion having a pair of axially spaced annular grooves therein, each adapted to receive said spring means therein, said elongated portion being slidably movable inside said hollow guide sleeve means between first and second positions, said spring means being resiliently urged into a selected one of said pair of annular grooves when said elongated portion is in one of said first and second positions to hold said elongated portion at said one of said first and second positions.

12. In a ladder comprising at least one ladder element haivng a pair of parallel sidepieces and plural crosspieces fastened to said sidepieces, the improvement wherein said crosspieces of said ladder element are elongated hollow profiles having opposite ends, said opposite ends being closed by pressing the material thereat together to form an end edge, and wherein said sidepieces of said ladder element each have a longitudinal groove into which is received and fastened a said end edge of a said crosspiece.

13. The ladder according to claim 12, wherein said ladder element is a telescopic ladder element supported longitudinally movably on a further ladder element, said further ladder element having further sidepieces to which are fastened further crosspieces, said sidepieces of said telescopic ladder element resting against an outer side of each of said further sidepieces of said further ladder element, and wherein said sidepieces of said telescopic ladder element have a substantially U-shaped cross section so that said sidepieces of said telescopic ladder element also at least partially grip around said sidepieces of said further ladder element.

14. The ladder according to claim 13, wherein a locking means is provided on said telescopic ladder element for locking at least one of said sidepieces of said telescopic ladder element to at least one of said further sidepieces of said further ladder element.

15. The jointed ladder according to claim 12, wherein a connecting element is supported on an upper end of each of said sidepieces of at least one telescopic ladder element, which connecting element can be fastened to an upper end of a respective sidepiece of an other telescopic ladder element.

16. The jointed ladder according to claim 15, wherein a locking means is provided on said telescopic ladder element for locking at least one of said sidepieces of said telescopic ladder element to at least one of said further sidepieces of said further ladder element, said locking means including an elongated portion with a knob at one end thereof, wherein said connecting element includes an elongated fishplate and pivot means for pivotally supporting one end of said fishplate on a respective sidepiece of said telescopic ladder element, a free end of said fishplate having an opening therein to guide said elongated portion of said locking means on a further telescopic ladder element therethrough.

17. The jointed ladder according to claim 16, wherein said upper end of said sidepiece of said further telescopic ladder element is provided with means defining a slotlike recess to guide said fishplate therethrough.

18. The jointed ladder according to claim 16, wherein said fishplate is supported on said at least one telescopic ladder element below its respective locking means.

19. The jointed ladder according to claim 12, wherein an extension stay is supported on a lower end of said sidepiece of said telescopic ladder element.

20. The jointed ladder according to claim 19, wherein said extension stay is movably along said sidepiece and is fixedly positioned by said locking means.

21. The jointed ladder according to claim 12, wherein lower ends of said sidepieces of said telescopic ladder element are spread apart laterally.

22. The jointed ladder according to claim 12, wherein joints connect two of said further ladder elements, when the ladder is used as a leaning, not free-standing ladder, which joints are pivotal over a range of approximately 180° and can be maintained fixedly positioned in this position as well as in intermediate positions.

* * * * *